US005201909A

United States Patent [19]

Von Wyl et al.

[11] Patent Number: 5,201,909

[45] Date of Patent: Apr. 13, 1993

[54] LIQUID-COOLED CONTINUOUS CASTING MOLD

[75] Inventors: Horst Von Wyl, Duisburg; Franz-Ulrich Laumeier, Essen; Hans-Joachim Biedermann; Martin Brüggemann, both of Duisburg; Ralf Schneider, Mettmann; Hans Siemer, Essen, all of Fed. Rep. of Germany

[73] Assignee: Mannesmann Aktiengesellschaft, Dusseldorf, Fed. Rep. of Germany

[21] Appl. No.: 734,437

[22] Filed: Jul. 23, 1991

[30] Foreign Application Priority Data

Jul. 23, 1990 [DE] Fed. Rep. of Germany ..... 4023672
May 22, 1991 [DE] Fed. Rep. of Germany ..... 4117052

[51] Int. Cl.[5] ..... B22D 11/04

[52] U.S. Cl. ..... 164/418; 164/416; 164/443

[58] Field of Search ..... 164/416, 418, 443, 478

[56] References Cited

U.S. PATENT DOCUMENTS

| | | | |
|---|---|---|---|
| 2,814,843 | 12/1957 | Savage et al. | 164/418 X |
| 2,815,551 | 12/1957 | Hessenberg et al. | 164/416 X |
| 3,664,409 | 5/1972 | Kolomeitsev et al. | 164/416 |
| 4,867,226 | 9/1989 | Uehara et al. | 164/416 X |

FOREIGN PATENT DOCUMENTS

| | | | |
|---|---|---|---|
| 55-88957 | 7/1980 | Japan | 164/416 |
| 56-11134 | 2/1981 | Japan | 164/478 |
| 58-199645 | 11/1983 | Japan | 164/478 |
| 59-64142 | 4/1984 | Japan | 164/416 |
| 59-197350 | 11/1984 | Japan | 164/418 |
| 60-148645 | 8/1985 | Japan | 164/416 |

*Primary Examiner*—J. Reed Batten, Jr.
*Attorney, Agent, or Firm*—Cohen, Pontani, Lieberman, Pavane

[57] ABSTRACT

The mold continuous casting of metals includes a stationary base frame; a support plate within the base frame, the support plate including first and second opposed sides; a metallic shaping wall mounted on the support plate and having a longitudinal axis in the direction of casting; a carrier plate attached to the base frame; a plurality of spring elements each having two ends and being uniformly distributed over and fastened at one end thereof to the first side of the support plate, the other ends of the spring elements being fastened to the carrier plate, the first side of the support plate facing away from the shaping wall, the spring elements extending in a direction transverse to the direction of casting and having a stiffness which is substantially less in the direction of casting than in the two directions transverse thereto.

16 Claims, 8 Drawing Sheets

LIQUID-COOLED CONTINUOUS CASTING MOLD

FIELD OF THE INVENTION

The present invention relates to a mold for the continuous casting of metals, such as steel, whereby the mass to be moved is substantially reduced, thereby permitting higher oscillation figures and a lower power consumption.

BACKGROUND OF THE INVENTION

The present invention relates to a liquid-cooled ingot mold for the continuous casting of metals, particularly steel.

Depending on the shape of the strand to be produced (i.e., strand dimensions), tube molds are customarily employed for the production of billet, bloom and round castings, and plate molds for the production of slabs.

Regardless of the shape of the strand, the molds are oscillated in the casting direction. In this regard, a sinusoidal movement of the mold is preferred, and the speed of the downward movement of the mold is greater than the strand removal speed, which is generally constant (negative strip).

The frequency and the stroke of the oscillating movement are adapted to the speed of removal of the strand. Thus, for instance, with slab formats of a size of 250 mm×2,000 mm and strand removal speeds of 1.3 meters per minute, a frequency of about 100 oscillations per minute with strokes (amplitude of an oscillation) of 4 to 15 mm are customary values. With regard to the frequency, higher oscillation figures have also been proposed. The use thereof has, up to now, failed due to the mass to be moved. For the slab format indicated, the mass to be moved is about 30 tons. In the case of tube molds, such as those used for the production of round strands or rectangular strands in billet or bloom format (100–500 mm diameter or 100×100–400×400 mm), the mass of the mold is less and is somewhere between 1.3 and 2.5 tons. Here, comparable difficulties are noted when a given height of the frequency of oscillation in the case of small strokes and high strand removal speeds, for instance, 4 meters per minute or more, is to be assured with the retention of the "negative strip" and, therefore, the advanced movement of the mold as compared with the speed of removal of the strand upon the downward stroke.

SUMMARY OF THE INVENTION

An object of the invention is to reduce the suspension of the molds in the case of liquid-cooled oscillatably mounted molds with inclusion of the oscillation device in the mass to be moved, in order to be able to establish higher oscillation figures with the least possible power requirement.

This objective is achieved through a liquid-cooled mold for the continuous casting of metals, particularly steel, having a shaping wall consisting, of a metallic material, which wall is fastened to a support plate and is provided with connections for a cooling liquid for the cooling of the wall, characterized by the fact that: spring elements which are substantially less stiff in the direction of casting than in the two transverse directions are fastened on one side, uniformly distributed, to the support plate on the side facing away from the wall; that these spring elements extend in a direction transverse to the direction of casting; that the opposite ends of the spring elements are fastened to a carrier plate; that the carrier plate is attached to a stationary base frame; and that an oscillating device acts on the support plate.

BRIEF DESCRIPTION OF THE DRAWINGS

The invention will be explained in further detail and in reference to the drawings, in which.

DESCRIPTION OF THE PRESENTLY PREFERRED EMBODIMENTS

Figure 1:
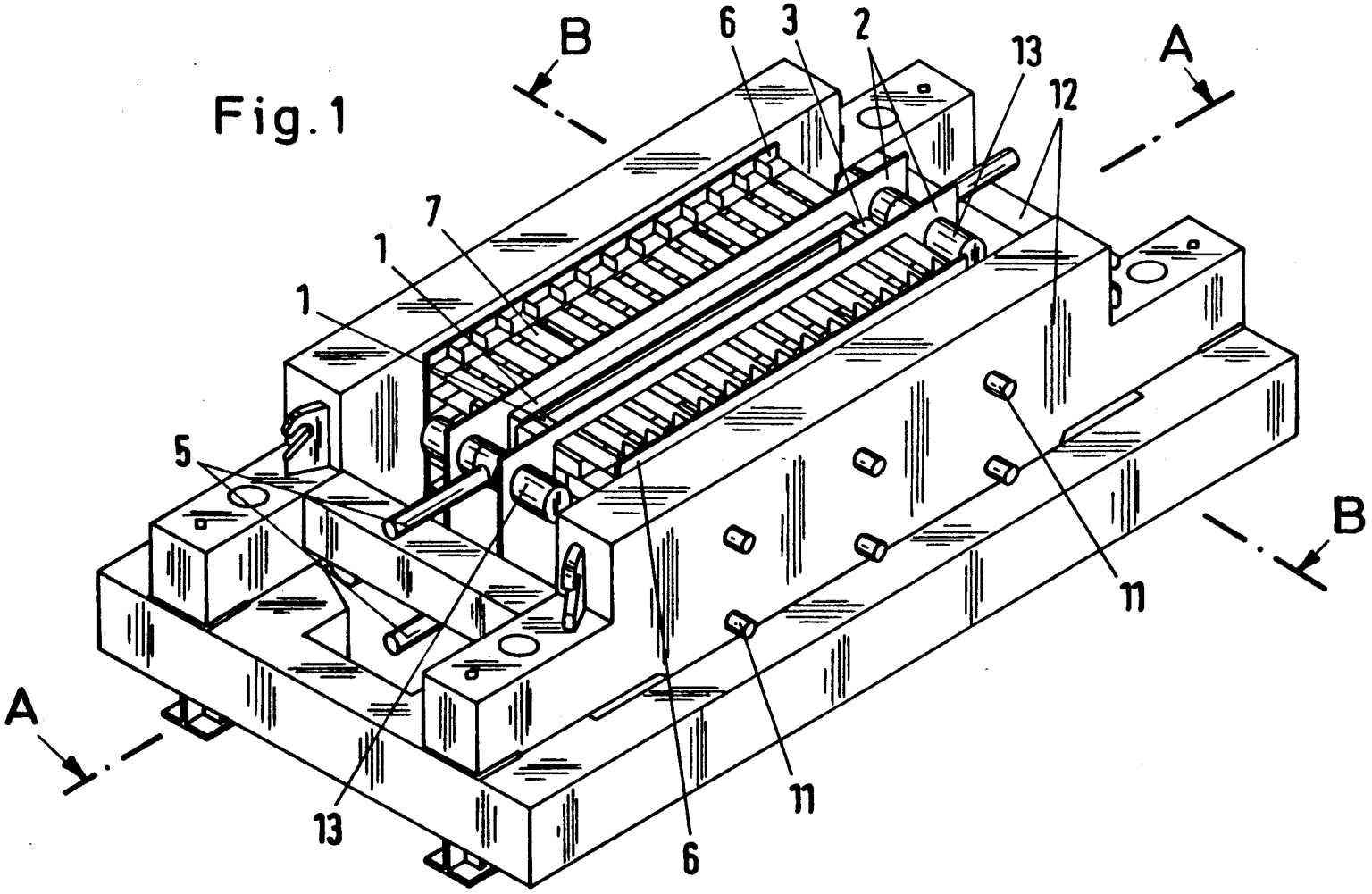
FIG. 1 is a perspective view of a plate mold for slabs.
Figure 2:
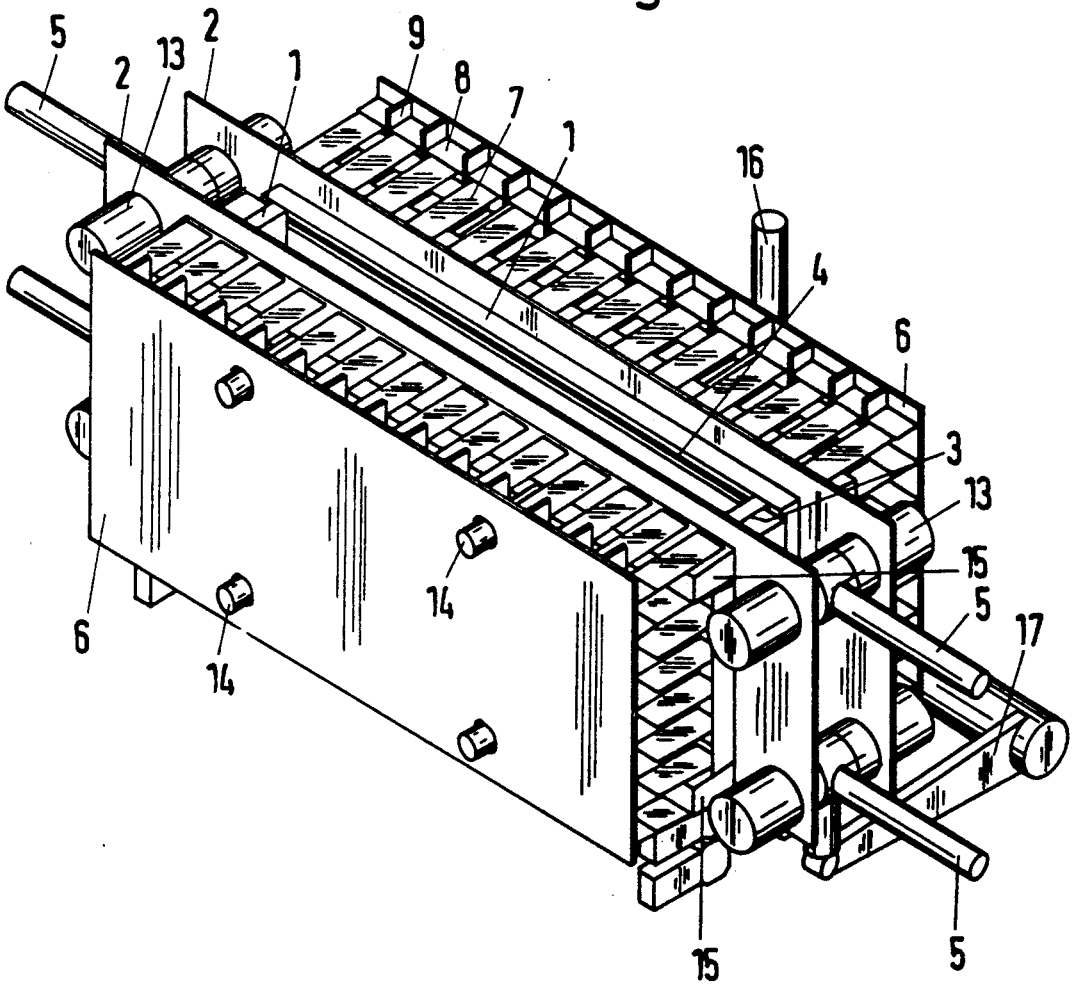
FIG. 2 is a perspective view of the region of the mold of FIG. 1, which is described in more detail by the invention.
Figure 3:
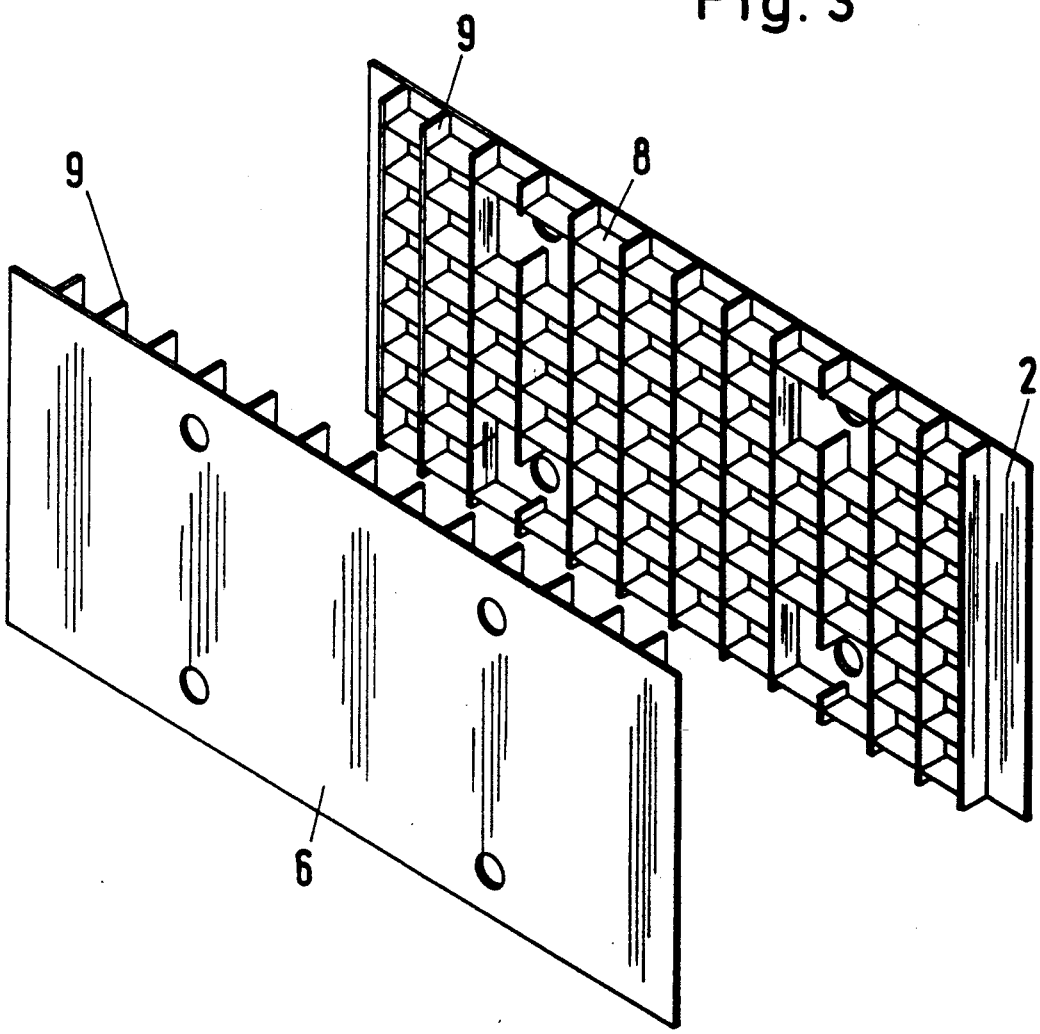
FIG. 3 is an individual illustration of a support and holding plate in accordance with FIG. 2.
Figure 4:
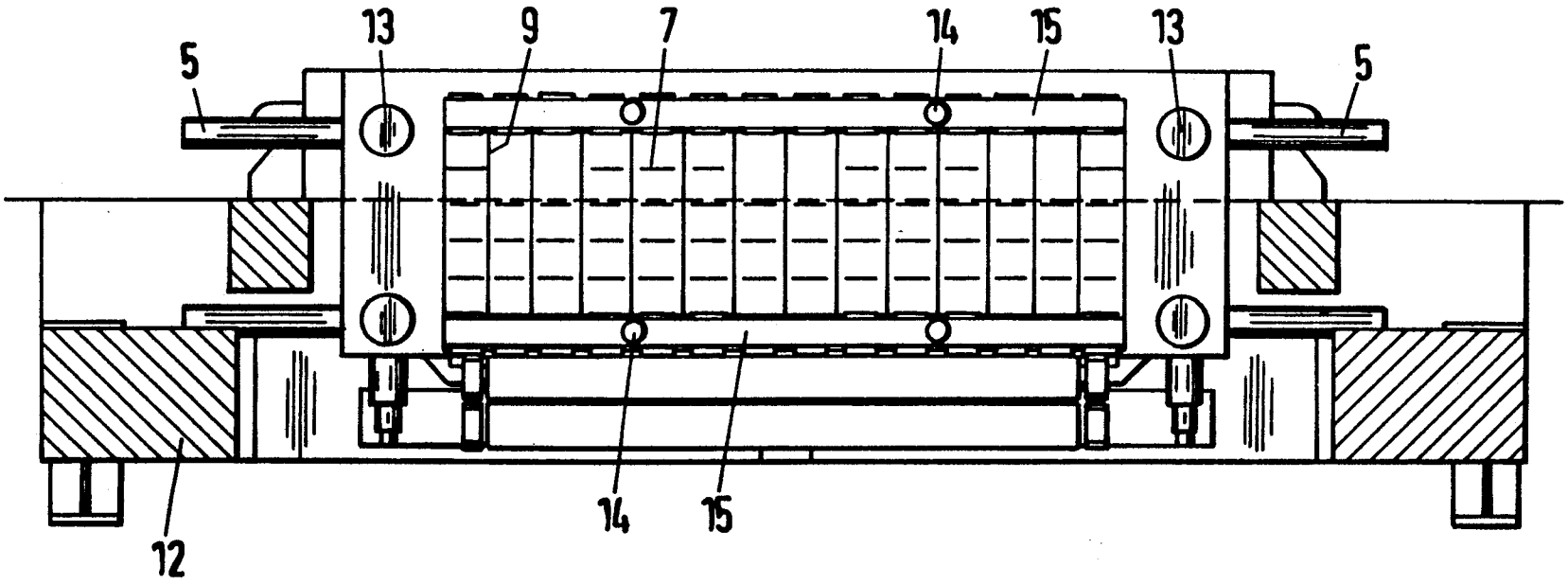
FIG. 4 is a side view along the section line A—A of FIG. 1.
Figure 5:
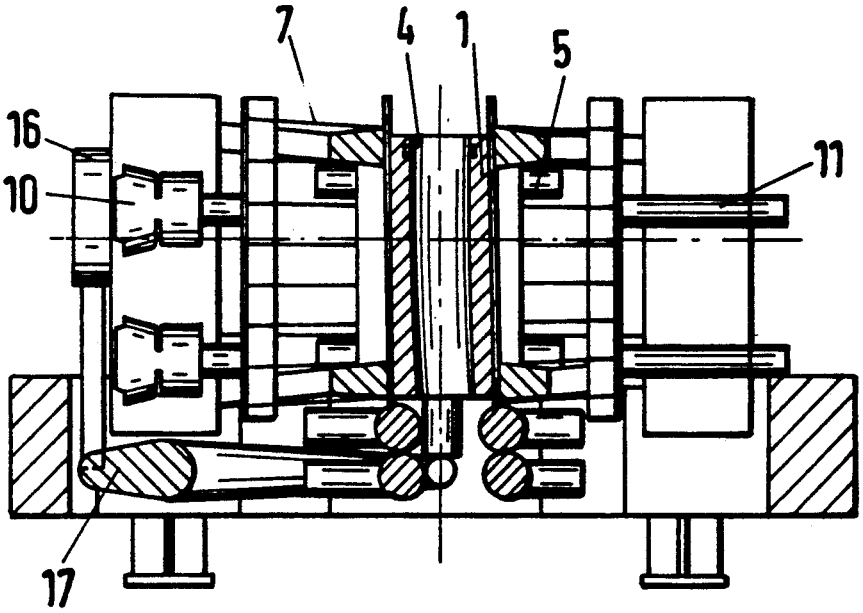
FIG. 5 is a section along the line B—B of FIG. 1.

The plate mold shown in FIG. 1 consists of the shaping wall 1 in the form of copper plates which form the mold cavity for the strand to be produced. The copper plates 1 are fastened to support plates 2. The copper plates 1 are water cooled. The cooling liquid is fed to and discharged from the support plates of the wide sides via flexible lines and the connections 14 and flow channel 15 (FIG. 2). The supplying of the copper plates 1 of the narrow sides fastened to support plates 3 with cooling liquid can be effected in the same manner. The narrow sides are clamped between the wide-side plates and are supported by displacement devices 5, by which, the width of the slab to be produced is established. In turn, displacement device 5 is fastened on clamping element 13 which connects the support plates 2 adjacent to the flow channels 15. On the outer surface of the support plates 2, facing away from the casting space, a plurality of spring elements 7, such as leaf springs, are fastened thereon. Of course, one can also employ as spring elements laminated bodies which are formed of leaf springs with intermediate layers of elastomers vulcanized therein. The leaf springs are uniformly distributed, and spaced from each other, over the surfaces of the support plate and the carrier plate, and extend transverse to the direction of casting. At their other ends, the leaf springs are fastened to a carrier plate 6. The carrier plates 6 are, in turn, fastened via spring-loaded hydraulically disconnectable setting elements 10 and adjusting elements 11 (see FIG. 5) on a stationary base frame 12 which surrounds the carrier plates 6 and the narrower side plates. By means of the setting and adjusting elements 10, 11 an adjusting and aligning of the wide sides to different thicknesses of slab with corresponding narrow-side plates is provided. The device 16, 17 necessary for the oscillation, shown in FIGS. 2 and 5 in the form of a hydraulic cylinder 16 as drive via a lever 17, acts on the support plate or plates 2 at the foot of the mold. Additionally, the narrow side plates are provided on their outer surfaces, which are in contact with the wide side plates, with shaping elements which engage in a form-locked manner and guides 4 which extend transversely to the direction of casting on the upper edge of the wide sides. As well, stiffening strips 9 which extend in the casting direction between the rows of the plurality of leaf springs which are arranged spaced one above the other, are arranged on the support plate of the carrier plate 6.

By this basic solution, the result is obtained that only the actual crystallizer itself and, therefore the copper plates with the corresponding support plates including the displacement device of the narrow sides, need be moved by the oscillation device. As compared with the customary slab molds, a reduction in the mass to be moved by about 60% is obtained. In this way, one can, on the one hand, obtain a higher number of oscillations, while on the other hand, the drive 16 of the oscillation device can be smaller and can be fastened on the base frame 12. In this way, a shortening or reduction of the mechanism otherwise necessary to transmit forces from the drive to the mold is obtained at the same time. Another advantage results from the fact that the cooling water is fed to the oscillating plates 1, 2, 3 from the base frame 12 via hose connections 14 through the carrier plates 6 and a flow channel 15 arranged on the rear of the support plates 2. By conducting water over the wide sides, the use of several hose connections is made possible, so that the distribution of water and equalization of pressure can be performed substantially in the non-oscillating region of the mold, and the cross section of the flow on the moved support plates can be minimized. Furthermore, the upper and lower rows of spring plates can be developed in closed form and the sides can be sealed off by elastic elements so as to protect the structural parts contained within this area from the extremely corrosive environmental influences that exists around the plant.

Figure 7:
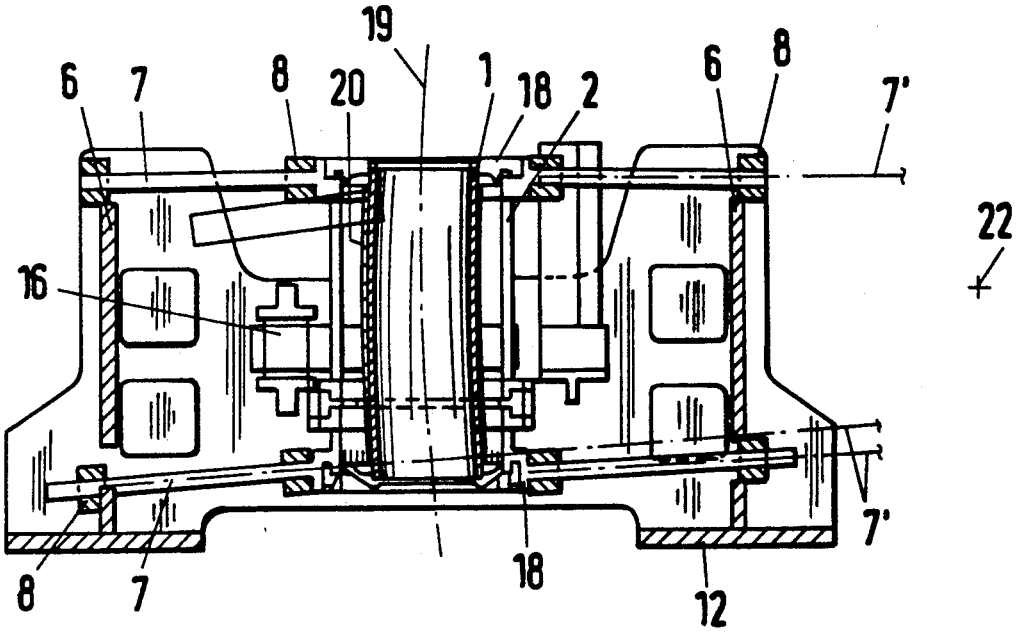
FIG. 7 is a section along the line C—C of FIG. 6.
Figure 6:
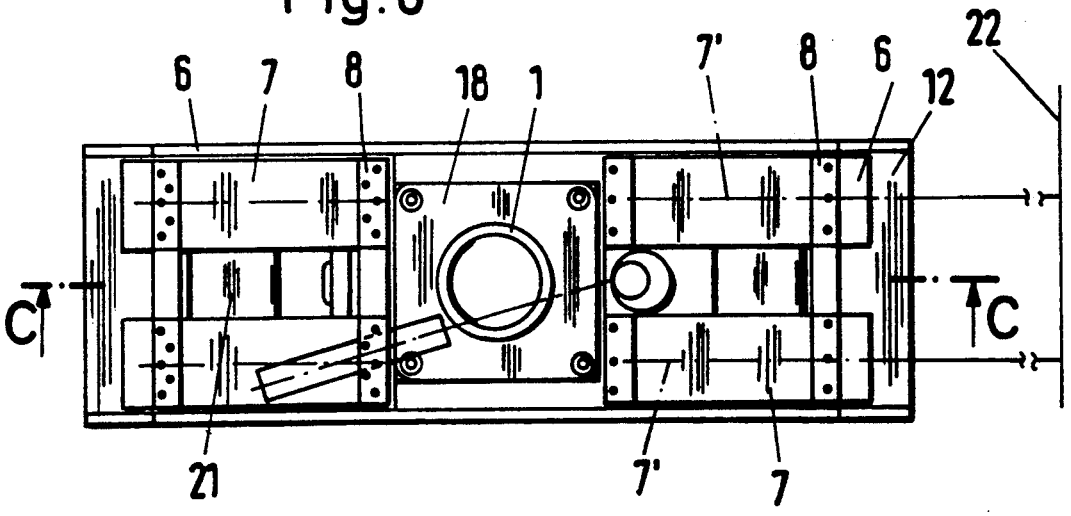
FIG. 6 is a top view of a tube mold.

In the case of the tube mold shown in FIGS. 6 and 7, the wall 1 which forms the mold cavity for the strand to be produced, consists of a copper tube of circular cross-sectional shape with curved longitudinal axis 19. Of course, tubes of rectangular or polygonal cross-sectional shape and straight longitudinal axis 19 can also be used. The copper tube 1 is surrounded in a known manner by a water jacket 20 and is held via flanges 18 provided on the tube ends and a tubular support plate 2 which surrounds the water jacket 20. The flanges 18 are of rectangular shape as seen in top view. On two opposite sides of the flanges 18 there are arranged, transverse to the direction of casting, the spring elements 7, in this case also developed as leaf springs. The spring elements 7 are connected by fastening strips 8 in each case to a carrier plate 6 which is connected to a base frame 12. The mold can be oscillated by a hydraulic cylinder 16, which acts on the support plate 2, and rests on the carrier plate 6 via a connecting arm 21.

Here, therefore, the oscillation drive 16 is connected directly to the mass to be oscillated without the interpositioning of the customary intermediate gears or intermediate arms. The spring elements 7 have their longitudinal axis 7' so aligned that their imaginary extensions intersect at the center of curvature 22 of the mold, i.e. or at a point on a line passing through the center of curvature 22 and extending perpendicular to the spring-element axis 7'. Since the "center of curvature" in the case of a tube mold with linear axis 19 lies at infinity, the spring elements 7 which are arranged above one another and fastened to the two tube ends are all parallel to each other.

It is within the scope of the present invention that, in the case of a mold with linear axis 19, the flange 18 is developed, as seen in top view, with a polygonal or round contour and the spring elements 7 are uniformly distributed in such a manner that the axes 7' of the spring elements 7 lie on a radius which extends from the axis 19 of the mold.

The invention can, of course, also be employed in a tube mold in which the cooling is effected through cooling channels extending in the wall 1. In this case, the tubular support plate 2 can rest directly against the wall 1 and the attachment of the spring elements can be effected similar to the manner described in the case of the slab mold.

As can be noted from the above remarks, the connection between stationary mold parts (carrier plates) and moveable mold parts (support plates) via the spring elements can be so designed, particularly in the case of slab molds, that a relative movement of the inner plates with respect to the outer plates in the direction of casting by the basic oscillation stroke is possible;

the inner and outer plates form a unit which is rigid to bending around the vertical axis (in particular, as a result of thermal stresses);

radial forces from ferrostatic pressure and the required initial clamping as well as shear forces in the direction of the long edge of the slab can be transmitted from the inner plate to the outer plate;

the natural frequency of the total spring stiffness of the spring leaves in combination with the oscillating mass of the mold corresponds precisely to the desired maximum operating frequency; and the highest possible precision in guidance on the casting radius is assured due to the dynamic zero position (static sag) in the region of the oscillation amplitude provided.

The technical design of a plant in accordance with the invention will now be described with reference to an example. A strand of a size of 1600×250 mm is to be produced with a maximum strand removal speed of 3 m per minute in a bow-type caster with a radius of 10,500 mm. The oscillating mass results from the strand format to be cast and the structural design of the crystallizer plates used. If, with other requirements, these parameters change, this fact can be taken into account by a corresponding change in the spring parameters. The following values are selected for the mold:

| | |
|---|---|
| Oscillating mass | = 5000 kg |
| Maximum stroke | s = ±2.2 mm |
| Maximum frequency | f = 6 Hz |
| Length of spring elements | l = 350 mm |
| Width of spring elements | b = 70 mm |
| No. of spring elements | n = 2 × 8 × 14 = 224 |

Stroke and frequency result from the casting speed which is to be obtained, small amplitudes and high frequencies being preferred in accordance with the basic concept, since with increasing operating frequency the spring stiffness required for resonance increases and the static sag thus decreases, and with smaller amplitude the alternate flexural stressing of the spring leaves decreases.

Length, width and number of spring elements result substantially from the installation space available and the construction of the crystallizer plates used; in this connection, different designs are definitely possible, the thickness of the springs being then correspondingly adjusted.

Based on the above data, the following values result:

| | |
|---|---|
| Total spring rate | C = 7170 N/mm |
| Thickness of spring element | d = 3.6 mm |
| Static lowering | $\Delta y = -6.8$ mm |

The required total spring rate of the system is calculated for the desired maximum operating frequency as $C=m\times(2\pi\times f)^2$.

With a mold designed in this manner, there is obtained an accuracy of guidance, i.e. deviation of the edge of the mold from the casting radius of $<10\ \mu m$.

The accuracy of guidance is, therefore, dependent on the dimensions and the position of installation of the spring elements. The spring elements are arranged as follows:

Starting from an alignment in which the extension of the imaginary connecting lines of inner and outer attachment points of all spring elements point to the casting center, the mold-size attachment points are shifted upward by an amount equal to the static sag. This arrangement is a prerequisite for only slight deviation of all points of contact between strand and shaping wall.

Figure 8:
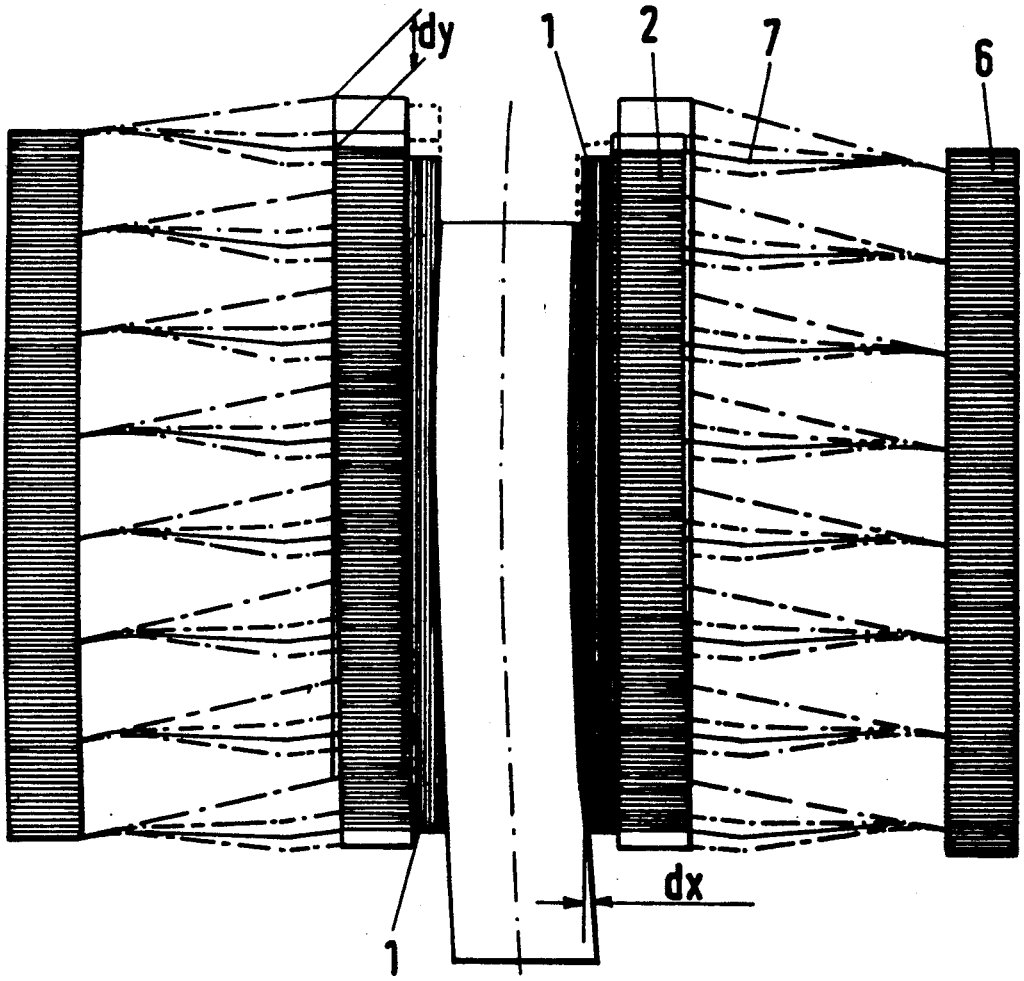
FIG. 8 is a basic diagram showing the position of the spring elements.

By static sag there is understood in this connection a change in position of the spring elements due to the loading with the mass to be oscillated. Starting from the structural zero position, the dynamic zero position and, therefore, the "oscillation center point" is determined by offsetting the attachment point of the spring elements on the support plate by an amount equal to the static sag. In FIG. 8, the two shaping walls which receive the strand therebetween are designated by the reference numeral 1. The shaping walls are fastened to the support plates 2. The support plates 2 are connected to the carrier plate 6 by spring elements 7. Elements dx and dy refer to movements in the x and y directions.

With respect to the position of the springs and the support plates 2 and carrier plates 6 with respect to each other, the "structural zero position" is designated *a*. The point of attachment of the leaf springs 7 to the support plate is offset by an amount equal to the static sag. The dynamic zero position *b* results from this. The dynamic zero position is at the same time the operating point around which the support plate 2 with the shaping wall 1 oscillates, the upper dead center of the oscillation being designated *c* and the lower dead center of the oscillation being designated *d*. For the above-described design of a mold in accordance with the present invention, a hydraulic cylinder is particularly preferred as oscillation drive. Since the oscillating plates oscillate within the resonance range as a result of the spring design, the hydraulic cylinder can be small since, basically, only the friction between mold wall and outer surface of the strand need be overcome. Since, furthermore, the hydraulic cylinder can be operated with operating pressures of less than 10 bar, the cooling water system of the mold or that of the machine cooling can be used, for instance, as source of power. Furthermore, the solution produced in accordance with the present invention commends itself, due to the construction with minimum space requirement, for use in multiple continuous casting plants for billet and bloom formats.

As a whole, the following are considered, in particular, to be advantages of the present invention:

Minimum oscillating mass;

Few oscillating parts and, accordingly, less influence of the natural frequency of parts participating in the oscillation on the desired course of the oscillation;

High precision of guidance, play-free and low-wear design as a result of the construction;

Simple drives—for example, plungers which can be used as drive element—since the oscillation is self-produced within a short time by the spring and kinetic energy stored in the system;

Reduction of the required drive power by utilization of resonance;

Due to the high frequency possible with very small amplitude an improvement in the quality of the surface with, at the same time, an increase in the speed of casting.

It is also possible to produce non-sinusoidal distance-time courses of the oscillation of the mold with sinusoidal power-controlled excitation.

The development of the spring elements will be explained below with reference to FIGS. 9–11. It is particularly advantageous in this regard that the spring elements can be manufactured as coherent units or as spring packages which then need only be pushed in simple manner into the clamping jaws before screwing and thus attachment to corresponding brackets of the support plate and carrier plate takes place. For the installation, no differences are noted whether the spring element is an individual spring or whether there is a multiple arrangement of, for instance, two or three springs. Correspondingly dimensioned shims are provided for the spacing and mounting of the spring element or elements in the clamping pieces and, thus, the clamping jaws.

In these drawings the parts of the mold between which the spring elements are arranged have not been shown.

Figure 9:
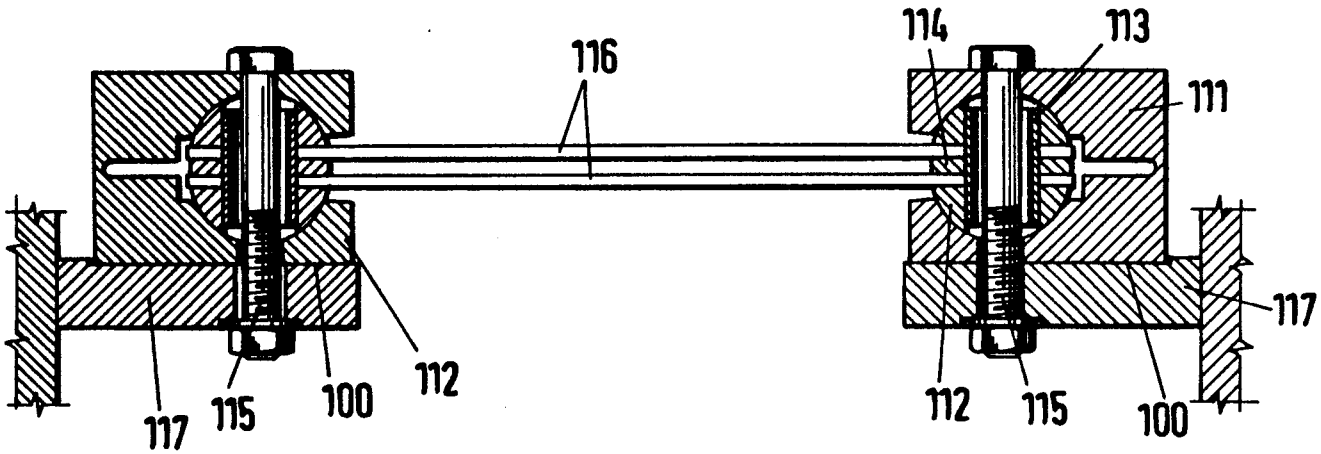
FIG. 9 is a longitudinal section through the mounted spring elements.
Figure 10:
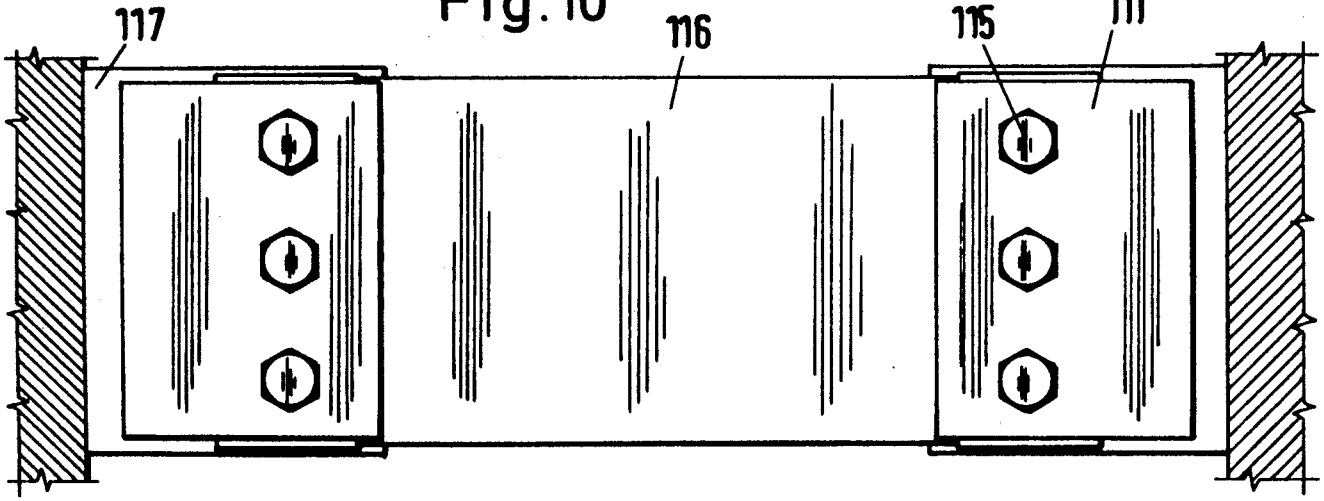
FIG. 10 is a top view of FIG. 9.

However, it can be noted in detail from FIG. 9 that brackets 117 are arranged on the support plate and carrier plate. These brackets form resting surfaces for the clamping jaws 111. The clamping jaws 111, viewed in cross section, have a circular hole. Clamping pieces 112 are arranged in this hole, they being produced from two cylindrical sections. As can be noted from FIG. 9, these clamping pieces are adapted in their shape to the hole in the clamping jaws and have, again seen in cross section, a semi-circular surface resting against the inner wall of the hole as well as a flat surface which face(s) the spring element or elements. In the embodiment shown in FIG. 9, two spring elements 116 are provided. Between these two spring elements 116, at the corresponding ends and, therefore, in the region of the clamping jaws or clamping pieces, there is a shim 114 which maintains their spacing. This shim, having flat parallel surfaces, is adapted upon manufacture to the desired size of the spring package provided.

Figure 11A:
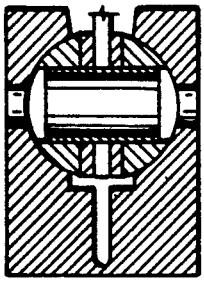
FIGS. 11*a–c* show details of the arrangement of 1, 2 and 3 springs respectively.
Figure 11B:
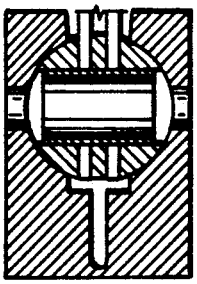
Figure 11C:
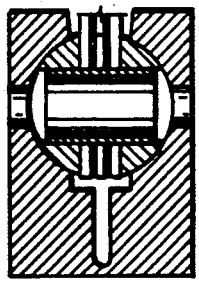

If the spring elements always have the same dimensions, the shims can also always be made of flat material of the same thickness. In FIG. 11*a*, differing from the showing in FIG. 9, there is only one spring element, corresponding shims being shown here on top and on bottom. By way of comparison, FIG. 11*b* corresponds to the showing in FIG. 9 and, finally, FIG. 11*c* shows an arrangement with three spring elements in which correspondingly thinner shims are used. Upon the manufacture of the spring elements, passage holes are drilled through the clamping pieces and the spring element of elements and, thereupon, an adapter sleeve 113 is hammered-in, which then holds the spring element or elements with the clamping pieces at both ends. This unit can then be pushed laterally into the holes in the clamping jaws and, thereupon, the screws 115 are passed through a corresponding hole in the clamping jaws or through the adapter sleeve and the bracket 117 and, thus, upon the screwing there takes place not only an adjustment but also a firm attachment between the spring elements and the bracket via the clamping pieces or jaws. It is essential—and this can be noted from FIG. 9—that the screws 115 have a smaller diameter than the inner dimension of the adapter sleeve. By means of the surfaces of the clamping pieces or jaws which are adapted in their shape and the dimensioning of the clamping screws, the result is obtained that in the operation of the mold both axial forces and bending moments resulting from the spring elements are transferred by frictional lock to the brackets. In this connection, the attachment described acts in operation like a rigid connection. The action as rotary or cylindric joint is limited to the adjustment process.

It should be understood that the preferred embodiments and examples described are for illustrative purposes only and are not to be construed as limiting the scope of the present invention which is properly delineated only in the appended claims.

What is claimed is:

1. A liquid cooled mold for the continuous casting of steel along a direction of casting comprising:

a stationary base frame;

a support plate within said base frame, said support plate comprising first and second opposed sides;

a metallic shaping wall mounted on said support plate and having a longitudinal axis in the direction of casting;

a carrier plate attached to said base frame;

a plurality of spring elements each having two ends and being uniformly distributed over and fastened at one end thereof to said first side of said support plate, said other ends of said spring elements being fastened to said carrier plate, said first side of said support plate facing away from said shaping wall, said spring elements extending in a direction transverse to said direction of casting and having a stiffness which is substantially less in said direction of casting than in the direction transverse thereto.

2. The mold according to claim 1, wherein said wall is a tubular wall comprising a first and second end, said mold further comprising two rectangular flanges on said support plate, said first and second ends of said tubular wall being fastened to a respective one of said flanges, and said spring elements being mounted to said flanges.

3. The mold according to claim 1, wherein said shaping wall having a plane and comprising a pair of first relatively longer side plates and a pair of opposing relatively narrow side plates displaceably arranged between said relatively longer side plates; said supporting plate for said wide side plate being arranged parallel to said plane of said shaping wall; said spring elements connecting said support plates with said carrier plates being arranged in rows extending along the respective height and width of said plates and further comprising spring actuated, hydraulically disconnectable means on said stationary base frame for setting and for adjusting said carrier plates; and said base frame surrounding said carrier plates, said spring elements, said support plates and said shaping wall.

4. The mold according to claim 3, wherein said relatively longer side plates having an upper end and guides on said upper end of said plates and said narrow side plate having outer surfaces facing said relatively longer side plates; and further comprising a shaped element on said outer surface of said relatively narrow side plate for mating engagement with said guides within said longer side plates, and said shaped elements being disposed transverse to said direction of casting.

5. The mold according to claim 1, further comprising a plurality of fastening strips on said support plate and said carrier plate for connecting said spring elements with said support plate and said carrier plate, said fastening strips being disposed parallel to each other and transverse to said direction of casting.

6. The mold according to claim 1, wherein said spring elements are leaf-type springs and further comprising a plurality of stiffening strips disposed on said carrier plate in said direction of casting between respective rows of said spring elements.

7. The mold according to claim 1, further comprising connectors at said shaping wall for feeding and discharging coolants; and flow channels disposed on said first side and in the upper and lower region of said support plate, and said flow channels being in liquid communication with said connectors.

8. The mold according to claim 3, further comprising a clamping element for connecting said support plates; and means connected to said clamping elements for displacing said relatively narrow side plates for varying the width of said casting mold.

9. The mold according to claim 1, wherein said mold has a required maximum frequency and that the total stiffness of said spring elements in said direction of casting is selected so that the swinging system comprising said spring elements and oscillating mass has a natural frequency equal to said required operating frequency.

10. The mold according to claim 1, further comprising clamping jaws for holding said ends of said spring elements;

a plurality of brackets on said support plate and said carrier plate for supporting said clamping jaws;

and a clamping screw passing through said clamping jaw and said spring elements for connecting said spring elements to said support plate and said carrier plate.

11. The mold according to claim 10, said clamping jaw having a circular opening therein;

and additionally comprising a clamping piece matingly engaging said circular opening, said clamping piece comprising a semi-circular surface for engagement with said circular opening of said clamping jaw and a flat surface for mounting said spring element.

12. The mold according to claim 11, wherein more than one spring element is mounted on said clamping piece.

13. The mold according to claim 11, wherein said spring element has a longitudinal axis and a hole therein extending perpendicular thereto;

said clamping pieces having a hole therein in alignment with said hole in said spring element;

and further comprising an adaptor sleeve extending through said holes for guiding said clamping screw therethrough.

14. The mold according to claim 13, wherein said clamping screw has an outside diameter and said adaptor sleeve has a clear inside diameter and wherein said outside diameter of said clamping screw is less than said clear inside diameter of said adaptor sleeve for providing a space therebetween.

15. The mold according to claim 1, wherein said shaping wall has a curvature in said direction of casting, said curvature having a center of curvature;

said spring elements comprising an axis transverse to said direction of casting, said axis of said spring element pointing toward said center of curvature of said shaping wall and points of fastening of said spring elements to said support plate;

said points of fastening of said spring elements to said support plate being offset by the amount of static sag so that said spring elements assume the same position in a loaded state as said springs would assume in an unloaded state and when said axes of said springs are intersecting said center of curvature or an axis passing through said center of curvature.

16. The mold according to claim 15, wherein said mold has an operating frequency and the amount of said offset is inversely proportional to the square of said operating frequency.

* * * * *